United States Patent [19]

Pauza

[11] Patent Number: 4,825,021

[45] Date of Patent: Apr. 25, 1989

[54] ELECTRICAL TAP CONNECTOR ASSEMBLY

[75] Inventor: William V. Pauza, Palmyra, Pa.

[73] Assignee: Amp Incorporated, Harrisburg, Pa.

[21] Appl. No.: 155,663

[22] Filed: Feb. 12, 1988

Related U.S. Application Data

[62] Division of Ser. No. 13,748, Feb. 12, 1987, Pat. No. 4,744,775.

[51] Int. Cl.[4] ..... H01R 33/96

[52] U.S. Cl. ..... 200/504; 200/51.1

[58] Field of Search ..... 200/153.5, 51.1, 51.09

[56] References Cited

U.S. PATENT DOCUMENTS

| | | | |
|---|---|---|---|
| 3,627,929 | 12/1971 | Vlijmer et al. | 200/51.1 |
| 3,895,318 | 7/1975 | Ross | 200/51.1 X |
| 3,949,180 | 4/1976 | Ojima et al. | 200/51.1 |
| 4,438,303 | 3/1984 | Astier | 200/51.1 |

FOREIGN PATENT DOCUMENTS 0020188 12/1980 European Pat. Off. .

*Primary Examiner*—Renee S. Luebke

[57] ABSTRACT

A tap connector assembly (10) for coaxial cable networks includes a receptacle tap connect or (6) incorporated into the cable network and a plug connector (8) mateable therewith to connect external apparatus into the network. Receptacle tap connector (6) includes first and second signal-carrying contacts (122, 123) and a grounding contact (19) adapted to be connected to signal-carrying conductors (24) and conductive outer sheaths (222) of first and second cables (**12*a*, 12*b*), respectively, in the network. Contact (19, 122, 123) are adapted to be engaged by terminals (186, 187, 188) in plug connector (8) when plug connector (8) is mated with receptacle tap connector (6) to connect external apparatus into the network. Receptacle tap connector (6) includes normally closed switch means (140) for providing a first signal path between signal-carrying contacts (122, 123) when the receptacle tap connector is not in use, and plug connector (8) includes a cam surface (205) for opening normally closed switch means (140) when the connectors are mated to interrupt the first signal path whereby only a second signal path is established between signal-carrying contacts (122, 123**) through the plug connector to connect the external apparatus into the network in series and to ensure that the integrity of the cable network is maintained at all times.

5 Claims, 5 Drawing Sheets

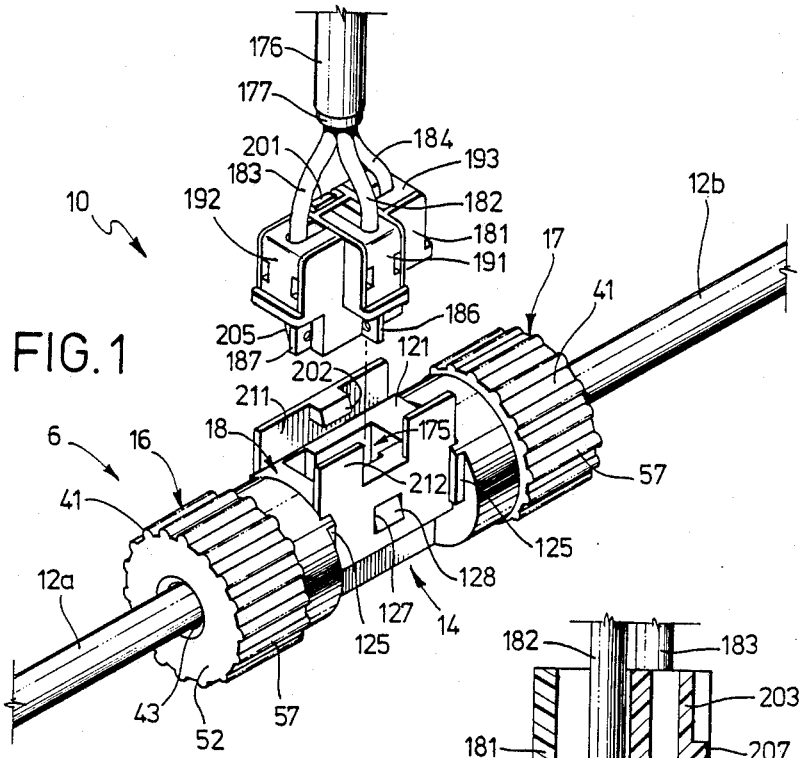
FIG. 1
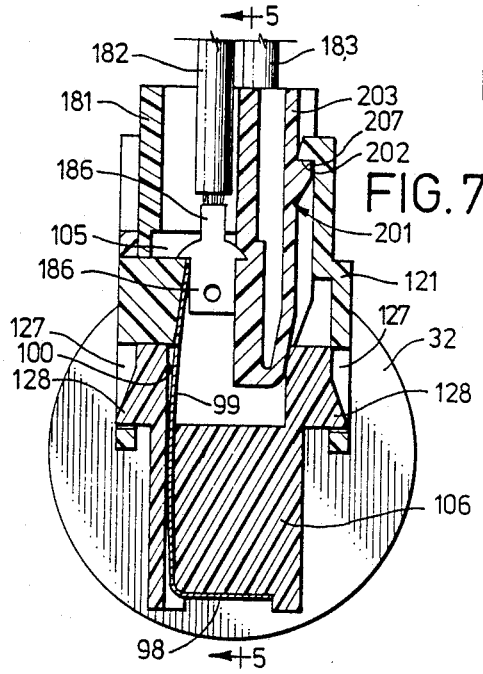
FIG. 7
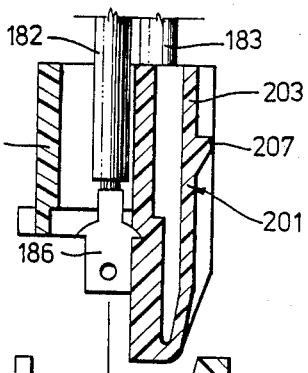
FIG. 6
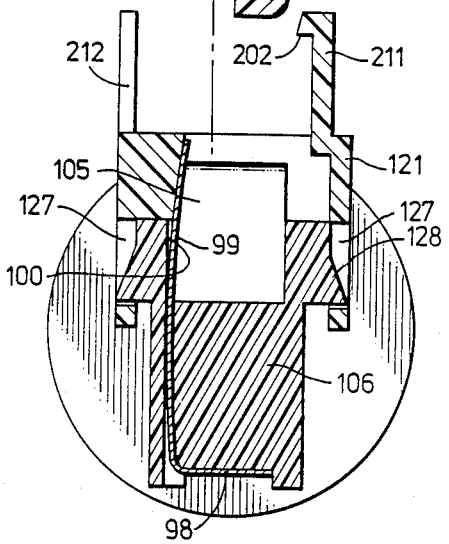

ELECTRICAL TAP CONNECTOR ASSEMBLY

This application is a divisional of application Ser. No. 013,748, filed Feb. 12, 1987, now U.S. Pat. No. 4,744,775.

BACKGROUND OF THE INVENTION

The present invention relates generally to the field of electrical tap connectors and, more particularly, to a tap connector assembly for coaxial cable networks.

One expanding use for electrical tap connectors is in the field of premises wiring. Premises wiring typically carries voice, electronic data, and/or electrical power over one or more electrical conductors and/or one or more optical fibers gathered together in a communications cable network. Workstations situated at various locations in the same building or in separate buildings are linked to the cable network by tap connectors; and the network, in turn, links the workstations to one another to receive or transmit data carried by the network.

The communications cable may take various forms. For example, the cable may comprise a twisted pair cable containing insulated wires that are spirally twisted together in pairs. Alternatively, the cable may comprise a coaxial cable containing one or more insulated conductors surrounded by a cylindrical, conductive sheath. Optical fiber cables may also contain a sheath surrounding the optical fibers within the cable to provide the cable with physical strength and to provide a shield to protect the fibers. Such a sheath may be electrically conductive to provide for a ground electrical potential along the sheath and along the length of the cable.

Tap connectors for coaxial cable networks were frequently relatively difficult to install and required special tools and skills for proper installation. In addition, many coaxial tap connectors were not effective in maintaining the integrity of the overall network when the connectors were not in use or when external apparatus was being plugged into or disconnected from the network.

SUMMARY OF THE INVENTION

The present invention relates to a tap connector assembly for electrical cable networks. The assembly comprises a tap connector for connecting first and second cables of the cable network, and a mating connector mateable with the tap connector to connect external apparatus into the cable network.

The tap connector includes a connector housing, first and second signal-carrying contacts carried by the housing and adapted to be electrically connected to signal-carrying conductors of the first and second cables, respectively, a third grounding contact carried by the housing and adapted to be connected to conductive sheaths of the first and second cables, and receiving means on the housing for receiving a mating connector, whereby the first, second, and third contacts are engaged by the mating connector when the mating connector is received by the receiving means to provide electrical connection of the first and second signal-carrying contacts and the third grounding contact with the mating connector.

Preferably, the connector housing includes normally closed switch means electrically connecting the first and second signal-carrying contacts to provide a first signal path between the first and second contacts and between the signal-carrying conductors connected thereto to maintain network integrity when the tap connector is not in use. The switch means includes means operated by the mating connector when the mating connector is received by the receiving means for opening the normally closed switch means. Accordingly, when the mating connector is mated with the tap connector, a second signal path is established between the first and second contacts through the mating connector; and the normally closed switch means is opened to interrupt the first signal path, thus providing a series connection with the cable network of apparatus connected by the mating connector.

According to a preferred embodiment of the invention, the switch means comprises a first stationary switch arm extending from the first signal-carrying contact, and a second movable switch arm extending from the second signal-carrying contact and positioned to normally engage the first switch arm to provide the first signal path between the signal-carrying contacts. The mating connector includes a cam surface positioned to displace the movable switch arm when the mating connector is mated with the tap connector and open the normallyclosed switch means.

Preferably, the tap connector comprises a receptacle tap connector; the mating connector comprises a plug connector; and the mating connector receiving means comprises a cavity in the receptacle tap connector for receiving the plug connector. During the mating of the plug and receptacle connectors, first and second contact terminals in the plug connector engage the first and second signal-carrying contacts in the receptacle tap connector, momentarily creating a dual signal path between the first and second signal-carrying contacts. Further insertion of the plug connector into the cavity in the receptacle tap connector causes the cam surface on the plug connector to engage the movable switch arm, separating it from the stationary switch arm leaving only the second signal path through the plug connector connected in the network. With the connector assembly of the invention, accordingly, the first signal path is not broken until after the second signal path is established. Similarly, when the plug connector is disconnected from the receptacle tap connector, the cam surface on the plug connector releases the movable switch arm, allowing the switching means to close and reestablish the first signal path prior to disconnection of the second signal path. Thus, with the present invention, network integrity is maintained at all times.

In accordance with a further aspect of the invention, the receptacle tap connector is designed to be easily assembled and incorporated into a cable network without specialized tools or skills. In particular, the receptacle tap connector includes a plastic housing, a grounding contact supported by the housing, first and second fitting assemblies for mounting the first and second cables to opposite ends of the housing, and a signal-carrying contact assembly containing first and second insulation-displacement, signal-carrying contacts and the switch means. The first and second fitting assemblies each include an electrically conductive member defining a first sheath-engaging surface, and the grounding contact includes a pair of disk-shaped portions defining second sheath-engaging surfaces.

To assemble the receptacle tap connector to a cable network, the first and second cable are extended through central apertures in the first and second fitting assemblies, respectively. Exposed portions of the shield or ground conductive sheaths of the first and second cables are then fanned out against the first sheath-engaging surfaces of the first and second fitting assemblies. The fitting assemblies are then attached to the housing to clamp the conductive sheaths of the first and second cables between the first clamping surfaces on the fitting assemblies and the second clamping surfaces on the grounding contact to electrically connect the conductive sheaths of the first and second cables to the grounding contact. The signal-carrying conductors of the first and second cables surrounded by inner dielectric sheaths extend into the housing when the fittings are attached to the housing. The signalcarrying contact assembly is then mounted to the housing, causing the first and second insulation-displacement, signalcarrying contacts to pierce the inner dielectric sheaths of the cables to electrically connect the contacts to the signal-carrying conductors of the cables and complete the assembly.

Further features and advantages of the invention will become apparent hereinafter in conjunction with the following detailed description of a presently preferred embodiment.

BRIEF DESCRIPTION OF THE DRAWINGS

FIG. 1 is an enlarged perspective view of a tap connector assembly according to a presently preferred embodiment of the invention;

FIGS. 6 and 7 are cross-sectional views of the unmated and mated connector assemblies of FIGS. 4 and 5 looking in the direction of arrows 6-6 and 7-7 in FIGS. 4 and 5, respectively;

DETAILED DESCRIPTION OF THE PREFERRED EMBODIMENT

Figures 2, 10:
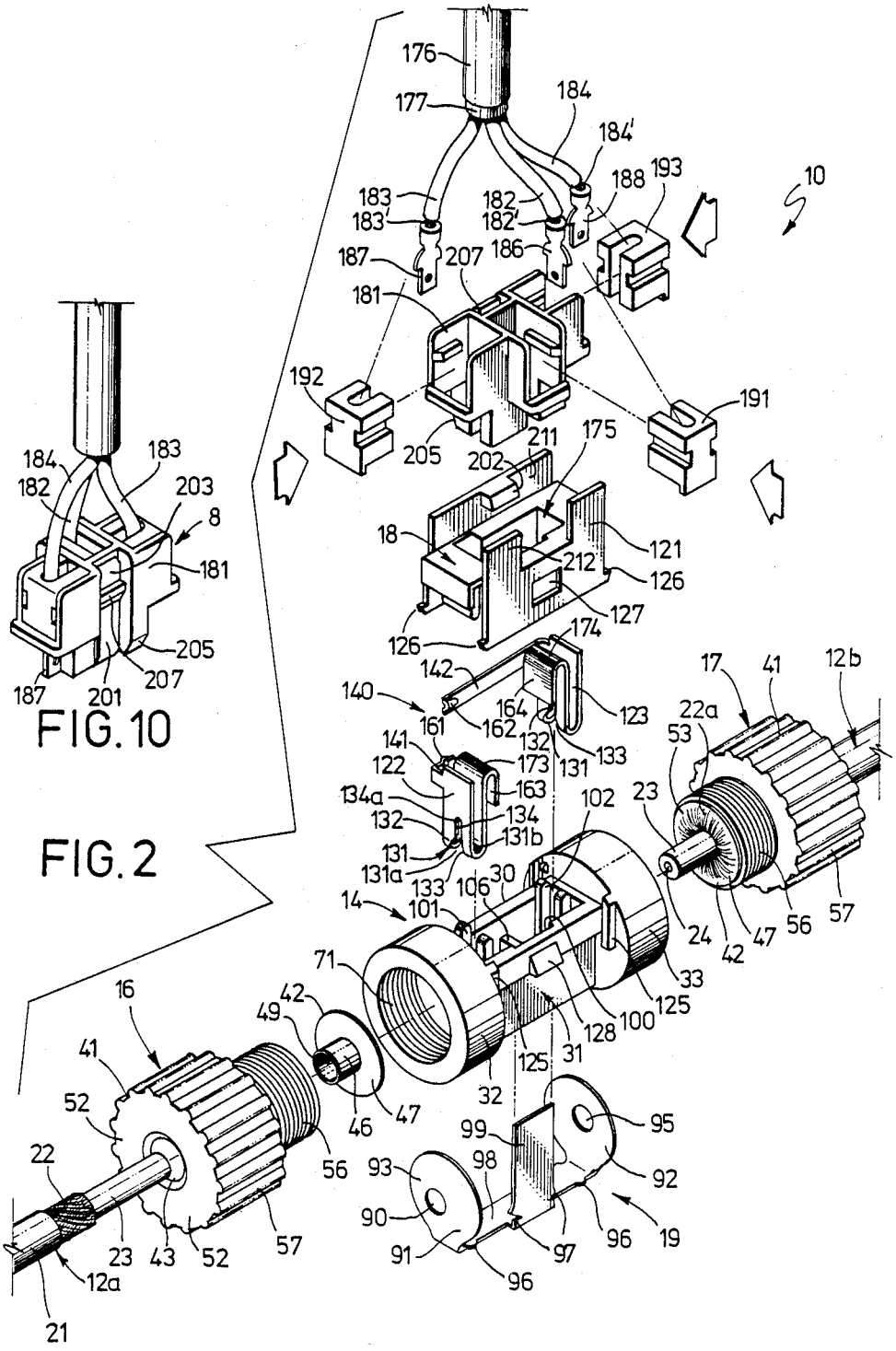
FIG. 2 is a partially exploded, perspective view of the tap connector assembly of FIG. 1.
FIG. 10 is a rear perspective view of the plug connector of FIGS. 1 and 2.

FIGS. 1, 2, 4, and 5 illustrate an electrical tap connector assembly according to a presently preferred embodiment of the invention. The connector assembly is generally designated by reference numeral 10 and includes a receptacle tap connector 6 adapted to be incorporated into an electrical cable network, and a plug connector 8 mateable therewith to connect external apparatus into the cable network. The connector assembly is particularly designed to provide access to a premises-wiring system although it should be understood that it is not intended to restrict the invention to any particular application.

Figure 3:
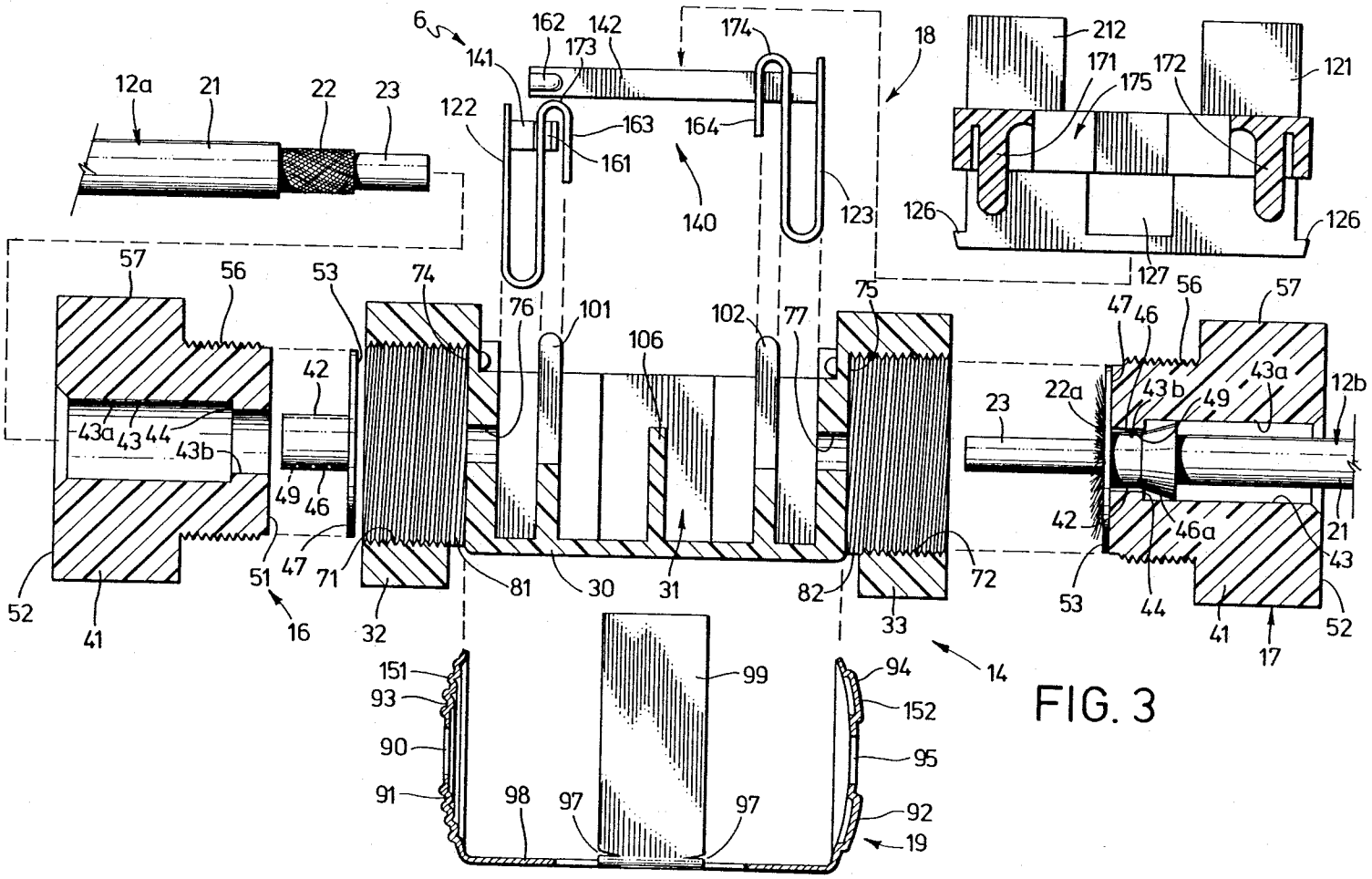
FIG. 3 is a partially exploded, cross-sectional view of the receptacle tap connector of FIGS. 1 and 2.

Receptacle tap connector 6 is adapted to connect two cables 12*a* and 12*b* in the cable network. As shown in FIGS. 2 and 3, cables 12*a* and 12*b* include an outer jacket 21 of polymeric, insulative material coaxially and concentrically surrounding an electrically conductive grounding sheath 22. Electrically conductive sheath 22, in turn, surrounds an insulative sheath 23 which contains the one or more transmission lines of the cables. The transmission lines can include one or more electrical conductors and/or one or more optical fiber conductors. In the embodiment described herein, the cables comprise coaxial cables carrying a single, signal-carrying electrical center conductor 24 axially within the conductive outer sheath 22.

Receptacle tap connector 6 is illustrated in detail in FIGS. 2–5 and is designed to be easily assembled and installed into a cable network without specialized tools or skills. Generally, receptacle tap connector 6 includes housing assembly 14, a pair of fitting assemblies 16 and 17, and a signal-carrying contact assembly 18. Housing assembly 14 will be described in greater detail hereinafter, but generally comprises an elongated, molded plastic housing 30 having a central cavity portion 31 for receiving and supporting signal-carrying contact assembly 18 and a grounding contact 19, and a pair of end portions 32 and 33 for receiving and supporting fitting assemblies 16 and 17, respectively, when the connector is assembled.

Figure 4:
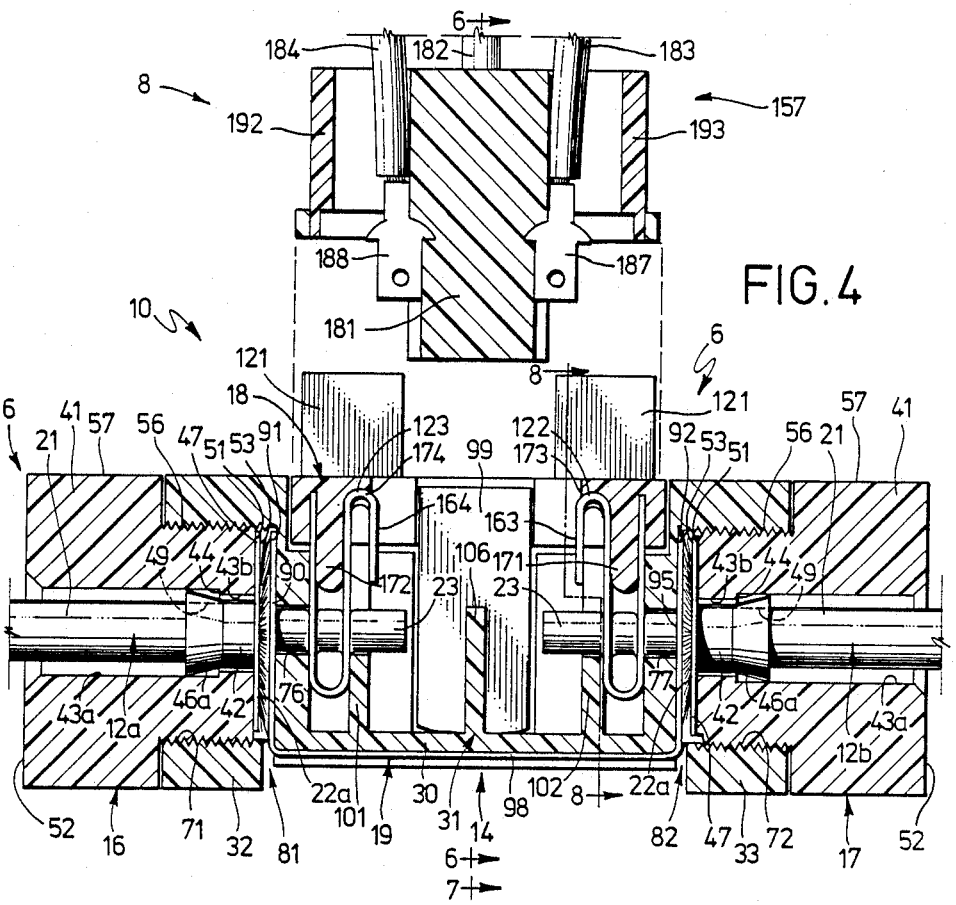
FIGS. 4 and 5 are cross-sectional views of tap connector assembly of FIGS. 1–3 in unmated and mated condition, respectively.
Figure 5:
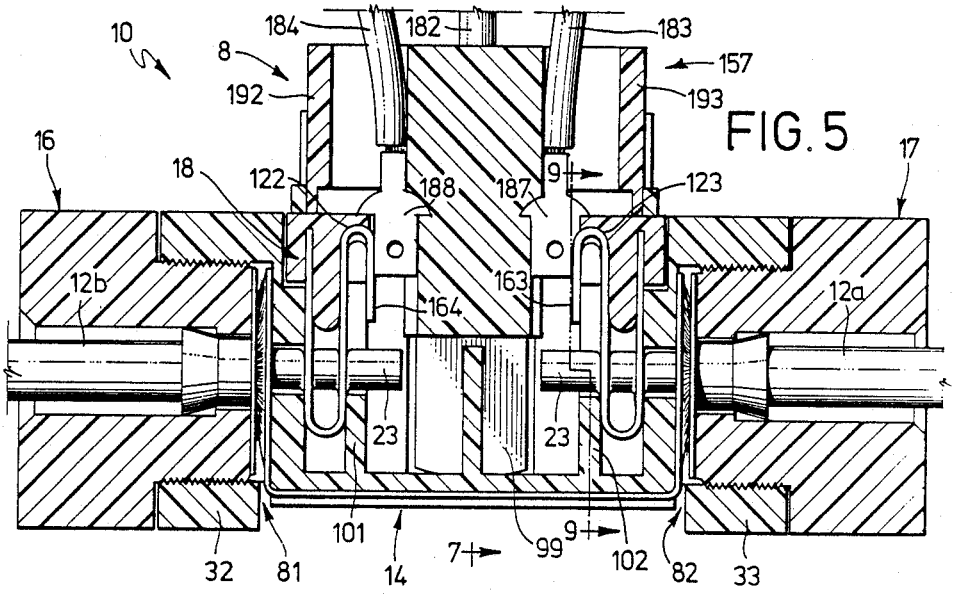

Fitting assemblies 16 and 17 are identical, and the same reference numerals are used herein to describe their construction. Each fitting assembly comprises a molded plastic, bolt-shaped fitting 41 having an electrically conductive member 42 attached thereto. Fitting 41 has a central passageway 43 extending axially therethrough, and an internal shoulder 44 of the passageway divides the passageway into first passageway portion 43*a* and second, reduced diameter, passageway portion 43*b*. Conductive member 42 comprises a relatively thin, metal member shaped to define a sleeve portion 46 and a flange portion 47. The sleeve and flange portions have a central opening 49 passing therethrough which is adapted to be aligned with passageway 43 in fitting 41 when the two components are assembled. More particularly, and as best shown in FIGS. 3–5, conductive member 42 is mounted to fitting 41 by extending sleeve portion 46 into passageway 43 until flange portion 47 contacts end face 51 of fitting 41. Following insertion, the end of sleeve portion 46 extending into passageway portion 43*a* is flared outwardly, as indicated at 46*a* in FIGS. 3–5, by a suitable tool to secure conductive member 42 to the fitting while allowing the conductive member to freely rotate relative to the fitting.

Fitting assemblies 16 and 17 so constructed comprise clamping members and are adapted to receive the ends of cables 12*a* and 12*b*, respectively. Prior to insertion of the cables into the fittings, the cables are prepared by cutting and stripping off a length of their outer dielectric jacket 21 to expose a portion of braided, conductive sheath 22 therein. A lesser portion of the conductive sheath is also removed to expose inner dielectric sheath 23. The cables so prepared are then inserted into and through passageways 43 of fittings 41 from ends 52 thereof and through openings 49 in conductive members 42. Insertion of the cables is limited by impingement of their outer jackets 21 against flared portions 46*a* of sleeve 46; however, conductive sheaths 22, dielectric sheath 23, and center conductors 24 pass fully through openings 49. Exposed conductive outer sheaths 22, after being passed through the fitting assemblies, are then fanned out, as shown at 22a, over outer surfaces 53 of radially extending flange portions 47 of conductive members 42 to complete assembly of the cables to the fitting assemblies. As will be explained hereinafter, surfaces 53 functon as first sheath-engaging surfaces or clamping surfaces for clmaping the conductive sheaths to receptacle connector 6.

Each of the fittings 41 includes an outer, threaded surface portion 56 for engagement with housing assembly 14 and a fluted portion 57 to provide an enhanced gripping surface for the worker to assist in insertion of the fitting assemblies into the housing assembly.

Fitting assemblies 16 and 17 are adapted to be inserted into and secured to end portions 32 and 33, respectively, of housing 30. End portions 32 and 33 define receses 71 and 72, respectively, which are internally threaded for attachment to threaded portions 56 of fitting assemblies 16 and 17, respectively. Recesses 71 and 72 have back walls 74 and 75, respectively, having small central apertures 76 and 77, respectively (FIG. 3), therein for receiving center conductors 24 of the cables and their insulative coating 23, as shown in FIGS. 4 and 5. The housing is molded from an insulative plastic to define narrow slots 81 and 82 extending into cavities 71 and 72, respectively, adjacent back walls 74 and 75 thereof. These slots are adapted to receive disk-like portions 91 and 92 of grounding contact 19. Outer surfaces 93 and 94 of disk-like portions 91 and 92, respectively, define second sheath-engaging surfaces or clamping surfaces to be clamped against first sheath-engaging surfaces 53 on flange portions 47 of conductive members 42 to clamp fanned-out portions 22*a* of outer conductive sheaths 22 therebetween when fitting assemblies 16 and 17 are mounted to housing assembly 14. Disk-like portions 91 and 92 include central apertures 90 and 95 for receipt of center conductors 24 and their insulative sheaths 23 when the cables are extended into housing assembly 14.

As best shown in FIG. 3, disk-like portions 91 and 92 of grounding contact 19 are of domed resilient spring configuration to provide stored spring energy to compensate for any creep characteristics of the plastic components when fitting assemblies 16 and 17 are screwed into ends 32 and 33 of housing 19. The grounding contact also includes a central strip 98 connecting the disk-like ends 91 and 92 and a center ground bar 99 positioned at right angles along one side of the strip. The grounding contact is secured to the housing by four bosses 96 on the central strip (FIG. 2) which are pressed into the inner surfaces of the sides of molded housing 30. Spring fingers 97 may also be provided on center ground bar 99 to engage a surface on housing 30 to further lock the grounding contact to the housing after the grounding contact is inserted into the housing.

When grounding contact 19 is inserted into housing 30, domed, disk-like portions 91 and 92 extend into slots 81 and 82, respectively, such that disk-like portions 91 and 92 are positioned within cavities 71 and 72 adjacent back walls 74 and 75 thereof. Center ground bar 99 extends through a slot 100 formed in the side of housing 30.

To assemble receptacle connector 6, grounding contact 19 is first inserted into housing 30. Fitting assemblies 16 and 17, having the ends of cables 12*a* and 12*b*, respectively, attached thereto, are then threaded into ends 32 and 33 of housing 30. Fanned-out braided portions 22*a* of outer sheaths 22 are sandwiched between sheath-engaging surfaces 53 on contact members 47 and sheath-engaging surfaces 93 and 94 on disk-like portions 91 and 92. As the fitting assemblies are screwed onto the housing, domed disk-like portions 91 and 92 collapse in a fashion similar to a bellville washer and are capable of recovering through spring action to an extent necessary to compensate for movement due to plastic creep of the threaded plastic elements. The conductive sheaths of the cables are thus firmly clamped to the connector and electrically connected to grounding contact 19 therein.

Second clamping surfaces 93 and 94 on disk-like portions 91 and 92 are preferably roughened to more firmly clamp fanned-out conductive sheaths 22*a* thereagainst. Such roughened surfaces can comprise, for example, a plurality of raised ridges or depressions on the surfaces. For illustrative purposes, FIG. 3 shows (in cross section) a plurality of circular ridges 151 on clamping surface 93, and a plurality of radial ridges 152 on clamping surface 94.

During threading of fitting assemblies 16 and 17 into housing 30, dielectric covered, but unshielded, signal-carrying, center conductors 24 of cables 12*a* and 12*b* pass through holes 90 and 95 in disk-like portions 91 and 92 of the grounding contact and into central cavity portion 31 of housing 30. The cables thus also function to retain grounding contact 19 within housing 30 when the receptacle connector is fully assembled. The covered center conductors pass over U-shaped rib structures 101 and 102 formed in central portion 31 which support the covered center conductors and function as anvils for connection of the center conductors to signal-carrying contact members as will be explained below. A centrally located wall 106 extends across central cavity portion 31 and serves as a stop and a dielectric barrier to ensure that the center conductors entering the central portion of the housing from the opposite ends do not inadvertently contact one another. Housing assembly 14 is now ready to receive signal-carrying contact assembly 18.

Signal-carrying contact assembly 18 comprises a contact housing 121 of molded plastic and a pair of signal-carrying contacts 122 and 123 supported within the housing.

Signal-carrying contacts 122 and 123 each include depending U-shaped portions which define slot means 131 composed of first and second slots 131a and 131b formed in the two sides of the U-shaped portions to receive exposed insulating layers 23 of cables 12*a* and 12*b*. Tapered areas 133 on the bottom of each slot guide insulating layers 23 into the slots, and edges 132 thereof comprise cutting edges for cutting through insulation layers 23 when contact assembly 18 is inserted into housing 30 to provide direct electrical contact between center conductors 24 of cables 12*a* and 12*b* and contacts 122 and 123, respectively. When contact assembly 18 is fully inserted into housing 30, center conductors 24 extend through narrow slot portions 134*a* and 134*b* of slots 131*a* and 131*b* to firmly clamp conductors 24 and reliabily establish electrical contact between the contacts and the center conductors (see FIGS. 8 and 9). Insulation-displacement contacts of the type utilized herein are known in the art and are disclosed, for example in U.S. Pat. No. 3,617,983.

On the upper ends of signal-carrying contacts 122 and 123 opposite slot means 131 and extending at right angles along one side of the contacts, are normally closed switch means 140 defined by switch arms 141 and 142. Switch arm 141 is fixed to contact 122 while longer switch arm 142 is movable with respect to contact 123. Switch means 140 is designed to provide a first signal path between signal-carrying contacts 122 and 123 and, hence, between signal-carrying conductors 24 of cables 12*a* and 12*b*.

Switch arms 141 and 142 include elongated embossment features 161 and 162 near their outer tips. Embossment features 161 and 162 are oriented to be at right angles to one another to describe a cross contact configuration when the switch arms are in contact with one another. Movable switch arm 142 is preferably formed in a preloaded condition such that when it is installed into the contact housing, movable arm 142 is in a somewhat flexed condition to ensure firm, reliable, electrical connection of the switch arms.

Signal-carrying contacts 122 and 123 also include flat portions 163 and 164 formed as continuations of the U-shaped portions. Flat portions 163 and 164 define connection areas for contact terminals contained in mating plug connector 8 as will be explained below. As best shown in FIGS. 4 and 5, molded features 171 and 172 on contact housing 121 provide support for the signal-carrying contacts; and curved contact portions 173 and 174 between the flat and U-shaped portions of the contacts bear against the molded contact housing features to provide support during insulation-displacement connection with the cables.

Insulation displacement connection occurs when signal-carrying contact housing assembly 18 is inserted into the central cavity of connector housing 30. During insertion of contact assembly 18, the center conductors of the cables are received within tapered areas 133 of slot means 131 of the contacts. During continued insertion, cutting edges 132 cut through protective sheaths 23 of the cables and allow the thus exposed center conductors of the cables to pass into narrow portions 134*a* and 134*b* of the slots to electrically connect the center conductors to the contacts. Anvils 101 and 102 in connector housing 30 and molded portions 171 and 172 in signal-carrying contact housing 121 provide backup support during cutting of the insulative layer of the cable. The size of narrow slot portions 134*a* and 134*b* is such as to firmly and reliably retain center conductor wires 24 therein; and by providing slots in the two sides of each U-shaped contact, even greater reliability is achieved. When the signal-carrying contact housing is inserted into the connector housing, center ground bar 99 of grounding contact 19 is received within a tapered slot 105 in the signal-carrying contact housing as best illustrated in FIGS. 6 and 7.

Signal-carrying contact housing 121 includes passive latching features 126 on its lowermost four corners which are positioned to engage projections 125 on connector housing 30, and active latching features 127 on each side to cooperate with latching features 128 on housing 30 to secure contact assembly 18 within connector housing 30.

Figure 8:
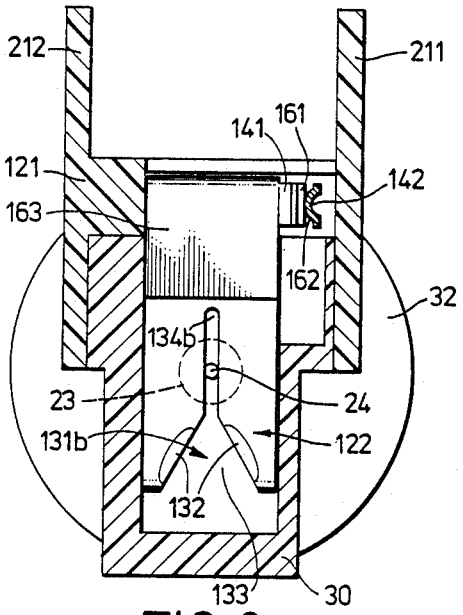
FIGS. 8 and 9 are cross-sectional views of the unmated and mated connector assemblies of FIGS. 4 and 5 looking in the direction of arrows 8-8 and 9-9 in FIGS. 4 and 5, respectively.
Figure 9:
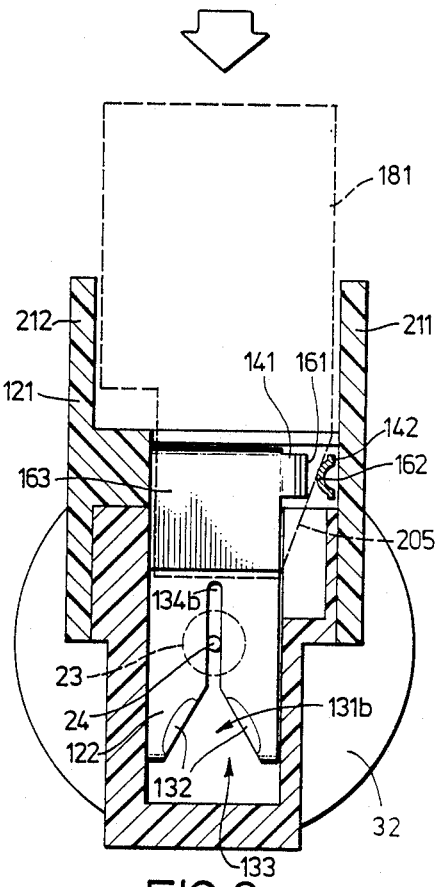

When signal-carrying contact assembly 18 is inserted into housing assembly 14, assembly of receptacle tap connector 6 and its connection to cables 12*a* and 12*b* is completed. When the receptacle tap connector is not being used to tap into the cable network, switch arms 141 and 142 are in contact; and switch means 140 is closed as shown in FIG. 8 to provide a first signal path within the receptacle tap connector housing between signal-carrying contacts 122 and 123 and, hence, between center conductors 24 of cables 12*a* and 12*b*. Similarly, the outer conductive sheaths of cables 12*a* and 12*b* are connected to grounding contact 19.

To tap into the cable network, plug connector 8 is inserted into recess or cavity 175 within signal-receiving contact housing 121 of receptacle tap connector 6. Plug connector 8 is connected to an electrical cable 176 having a conductive sheath 177, a pair of signal-carrying, insulation-covered conductors 183 and 184, and an insulation-coverd, third conductor 182. The conductors 182, 183, 184 include corresponding conductive portions 182', 183', 184' connected to corresponding conductive terminals 186. 187, 188, each of the terminals having a blade configuration that is of the type disclosed in U.S. Pat. No. 2,791,755. The terminals 186, 187, 188 are mounted on an external surface of an insulative housing 181 of plug 8 and are oriented on housing 181 to face, respectively, signal-carrying contacts 122, 123 and ground bar 99 of grounding contact 19. At least a portion of plug 8 and terminals 186, 187, 188 are constructed for removable insertion into a plug-receiving opening or recess 175 of contact housing 121. Upon said insertion, housing 181 of plug 8 urges terminal 186 to engage compressibly and slideably impinge ground bar 99 to establish an electrical connection of conductive sheath 177 of plug 8 to conductive sheaths 22 of cables 12*a* and 12*b* (see FIGS. 6 and 7. Also upon said insertion, housing 181 of plug 8 urges terminals 187 and 188 to engage compressibly and slideably impinge, respectively, flat surfaces 163 and 164 of signal-carrying contacts 122 and 123 to establish a second signal path between the first and second signal-carrying contacts through plug 8 (see FIGS. 4 and 5). Cables 182, 183, and 184 are retained within plug connector housing 181 by stuffer boxes 191, 192, and 193 as known to those skilled in the art.

Plug connector 8 includes a latching member 201 having a portion 207 adapted to engage a latching surface 202 in contact housing 18 when the plug connector is inserted into the receptacle connector to retain the connectors in mated condition (see FIGS. 6, 7, and 10). Latch 201 includes an extended finger portion 203 to readily permit the plug connector to be disconnected from the receptacle connector when desired. Extended ribs 211 and 212 formed in contact housing 121 help guide the plug connector into plug-receiving cavity 175 of the contact housing during mating.

Plug connector housing 181 is configured to define a cam surface 205 (see FIGS. 9 and 10) on the lower outside corner thereof. Cam surface 205 is positioned to engage movable switch arm 142 during mating of the connectors and to disengage it from switch arm 141 to interrupt the first signal path between signal-carrying contacts 122 and 123. More particularly, during mating of the connectors, ground connection is first made between grounding contact center bar 99 and grounding contact terminal 186 on the plug connector to connect the conductive sheaths in cables 12*a* and 12*b* to grounding cable 182. Further insertion of the plug connector into cavity 175 causes signal-carrying contacts 187 and 188 on the plug connector to engage flat portions 163 and 164 on contacts 122 and 123, momentarily creating a dual signal path through both the normally closed switch means 140 and the the plug connector. Further insertion and bottoming of the plug connector, however, cause cam surfae 205 to move movable switch arm 142 away from switch arm 141, thereby opening switch means 140 and leaving only a series connection from the cables 12*a* and 12*b* through the plug connector into workstation apparatus (not shown) connected to the plug connector. Of course, if and when the plug connector is disconnected from the receptacle connector, movable switch arm 142 is released by cam 205 and automatically returns back into contact with switch arm 141 to close switch means 140 and reestablish the first signal path between signal-carrying contacts 122 and 123.

With the present invention, accordingly, a tap connector assembly is provided which maintains network integrity at all times. The assembly includes a receptacle tap connector mountable to a coaxial cable network and which provides a first electrical signal path between two cables when the tap is not in use. The assembly also includes a plug connector mateable with the receptacle tap connector, which, when mated interrupts the first signal path after establishing a second signal path between the two cables through the plug connector and external apparatus connected thereby to establish a series connection of the external apparatus into the network.

The connector assembly is manufactured primarily from stamped and formed metal strip and molded plastic rather than machined, precision-made parts resulting in a connector that is of lower cost and capable of high-volume production.

While what has been described constitutes a presently preferred embodiment of the invention, it should be understood that the invention can take numerous other forms. Accordingly, it should be understood that the invention should be limited only insofar as is required by the scope of the following claims.

I claim:

1. A tap connector assembly for coaxial cable networks, comprising:

a receptacle tap connector adapted to be incorporated within said cable network, said receptacle tap connector comprising:

a connector housing; first and second signal-carrying contacts in said housing adapted to be connected to signal-carrying conductors in first and second electrical cables, respectively, in the cable network; and normally closed switch means electrically connecting said first and second signal carrying contacts for providing a first signal path between said first and second signal-carrying contacts; and a plug connector mateable with said receptacle tap connector to tap into said cable network, said plug connector including:

first and second electrical terminals for engaging said first and second signal-carrying contacts when said plug connector is mated with said receptacle tap connector for providing a second signal path between said first and second signal-carrying contacts through said plug connector;

means for opening said normally closed switch means when said plug connector is mated with said receptacle tap connector for interrupting said first signal path, a third grounding contact in said connector housing adapted to be connected to corresponding conductive outer sheaths of said first and second cables, respectively, and said plug connector includes a third contact terminal for engaging said third grounding contact when said plug connector is mated with said receptacle tap connector.

2. The connector assembly of claim 1 wherein said normally closed switch means includes a movable switch arm connected to one of said signal-carrying contacts, and wherein said switch-opening means includes camming means on said plug connector for engaging said movable switch arm when said plug connector is mated with said receptacle tap connector for opening said normally closed switch means.

3. The connector assembly of claim 2 wherein said camming means opens said normally closed switch means after said first and second electrical terminals engage said first and second signal-carrying contacts when said plug connector is mated with said receptacle tap connector.

4. The connector assembly of claim 1 wherein said grounding contact includes a pair of sheath-engaging surfaces, and wherein said receptacle tap connector further includes first and second clamping members having sheath-engaging surfaces and means for attaching said first and second clamping members to said housing for clamping the conductive outer sheaths of said first and second cables between said sheath-engaging surfaces of said grounding contact and said first and second clamping members, respectively, for connecting said conductive outer sheaths to said grounding contact.

5. The connector assembly of claim 4 wherein said first and second clamping members comprise first and second fittings having axial passageways for receiving said first and second cables, respectively, and wherein said housing includes passageways positioned to be aligned with the passageways in said first and second fittings when said first and second fitting are attached to said housing, whereby said first and second cables are extended through said axial passageways in said first and second fittings, respectively, said conductive outer sheaths of said first and second cables are clamped between the sheath-engaging surfaces of said first and second fittings and said grounding contact, respectively, and the signal-carrying conductors of said first and second cables are extended through said housing passageways and into said housing for connection to said first and second signal-carrying contacts, respectively.

* * * * *